US010081191B2

(12) United States Patent
Murayama et al.

(10) Patent No.: US 10,081,191 B2
(45) Date of Patent: Sep. 25, 2018

(54) METHOD OF DISCHARGING FLUID IN A LIQUID EJECTING APPARATUS

(71) Applicant: SEIKO EPSON CORPORATION, Tokyo (JP)

(72) Inventors: Masato Murayama, Matsumoto (JP); Ryoji Fujimori, Suwa (JP); Yuji Aoki, Hara-mura (JP); Toru Saito, Yamagata-mura (JP); Masakazu Ohashi, Shiojiri (JP); Keiichiro Yoshino, Matsumoto (JP); Satoru Kobayashi, Torrrance, CA (US)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 15/799,708

(22) Filed: Oct. 31, 2017

(65) Prior Publication Data

US 2018/0056656 A1 Mar. 1, 2018

Related U.S. Application Data

(63) Continuation of application No. 15/212,602, filed on Jul. 18, 2016, now Pat. No. 9,827,771.

(30) Foreign Application Priority Data

Aug. 3, 2015 (JP) ..... 2015-153383

(51) Int. Cl.
*B41J 2/175* (2006.01)
*B41J 2/165* (2006.01)
*B41J 2/14* (2006.01)

(52) U.S. Cl.
CPC ..... *B41J 2/175* (2013.01); *B41J 2/16523* (2013.01); *B41J 2/16526* (2013.01);
(Continued)

(58) Field of Classification Search
CPC .... B41J 2/175; B41J 2/17596; B41J 2/16532; B41J 2/16523; B41J 2/16526; B41J 2/17563; B41J 2/14145
See application file for complete search history.

(56) References Cited

U.S. PATENT DOCUMENTS 6,238,576 B1 * 5/2001 Yajima ..... B01D 35/26 210/194
2007/0120913 A1 5/2007 Mukai et al.
(Continued)

FOREIGN PATENT DOCUMENTS

JP 06-340084 12/1994
JP 2002-052737 2/2002
(Continued)

OTHER PUBLICATIONS

Office Action issued in U.S. Appl. No. 15/212,602 dated Dec. 22, 2016.
(Continued)

*Primary Examiner* — Yaovi M Ameh
(74) *Attorney, Agent, or Firm* — Workman Nydegger

(57) ABSTRACT

A liquid ejecting apparatus includes a liquid ejector that ejects a liquid, a liquid supply flow path that connects a liquid supply source and the liquid ejector, a plurality of branch flow paths provided in the liquid supply flow path, filters that are disposed separately in each of the branch flow paths, and a flow path opening/closing mechanism that opens and closes the branch flow paths.

12 Claims, 2 Drawing Sheets

(52) U.S. Cl.
CPC ..... *B41J 2/16532* (2013.01); *B41J 2/17563* (2013.01); *B41J 2/17596* (2013.01); *B41J 2/14145* (2013.01)

(56) References Cited

U.S. PATENT DOCUMENTS

| | | | | |
|---|---|---|---|---|
| 2007/0256566 | A1 | 11/2007 | Faber et al. | |
| 2010/0025321 | A1 | 2/2010 | Peng et al. | |
| 2011/0115844 | A1* | 5/2011 | Ozawa ..... | B41J 2/16552 347/28 |
| 2014/0111585 | A1 | 4/2014 | Nakamura | |
| 2015/0090340 | A1 | 4/2015 | Takayanagi et al. | |
| 2017/0036448 | A1 | 2/2017 | Murayama et al. | |

FOREIGN PATENT DOCUMENTS

| | | |
|---|---|---|
| JP | 2007-168421 | 7/2007 |
| JP | 2007-261234 | 10/2007 |
| JP | 2009-233979 | 10/2009 |
| JP | 2012-000846 | 1/2012 |

OTHER PUBLICATIONS

Office Action issued in U.S. Appl. No. 15/212,602 dated Jun. 15, 2017.
Notice of Allowance issued in U.S. Appl. No. 15/212,602 dated Aug. 1, 2017.

* cited by examiner

METHOD OF DISCHARGING FLUID IN A LIQUID EJECTING APPARATUS

BACKGROUND

1. Technical Field

The present invention relates to a liquid ejecting apparatus, such as a printer, and to a liquid supplying apparatus that supplies a liquid such as ink.

2. Related Art

An example of a liquid ejecting apparatus is an ink jet type printer that filtrates an ink from an ink tank by passing the ink through a filter before supplying the ink to a recording head (e.g., JP-A-2012-846).

In order to stably supply ink even when the amount of ink consumption is large, the area of the filter needs to be large to reduce the flow path resistance. However, if the area of the filter is increased, the cross-section area of a flow path at the filter increases and therefore the flow speed of the ink passing through the filter decreases.

Furthermore, in the case where ink contains undesirable substances such as bubbles, gel-like fluidal masses, it is preferable that such undesirable substances be trapped by a filter at the time of printing. However, at the time of a maintenance operation performed by causing ink to flow in order to discharge undesirable substances, it is preferable that the trapped bubbles or the like pass through the filter and be discharged from the recording head together with the ink.

Note that undesirable substances that have fluidity, such as bubbles, pass through the filter more easily as ink flows faster. Therefore, if the area of the filter is increased in order to stably supply ink, there arises a problem that the flow speed of ink at the time of maintenance decreases making it less easy for bubbles or the like to be discharged during the maintenance.

This problem is not limited to the printers that perform printing by ejecting ink but is substantially common among liquid ejecting apparatuses and liquid supplying apparatuses equipped with a filter disposed in an intermediate portion of a flow path.

SUMMARY

An advantage of some aspects of the invention is that a liquid ejecting apparatus and a liquid supplying apparatus in which the efficiency of trapping undesirable substances by a filter can be adjusted are provided.

Configurations and operations of such apparatuses according to the invention will be described below.

A liquid ejecting apparatus according to one aspect of the invention includes a liquid ejector that ejects a liquid to a medium, a liquid supply flow path that connects a liquid supply source and the liquid ejector, a plurality of branch flow paths for dividing the liquid into a plurality of flows in an intermediate portion of the liquid supply flow path, filters that are disposed separately in each of the branch flow paths, and a flow path opening/closing mechanism that opens and closes the branch flow paths.

According to this configuration, when the number of branch flow paths through which the liquid flows decreases, the liquid flows concentratedly in those reduced number of branch flow paths, so that the flow speed of the liquid that passes through the filters disposed in those branch flow paths increases. On the other hand, when the number of branch flow paths through which the liquid flows increases, the liquid flowing through the liquid supply flow path divides and flows into those increased number of branch flow paths, so that the flow speed of the liquid that passes through the filters decreases. Therefore, by increasing the number of branch flow paths through which the liquid flows, undesirable substances with fluidity, such as bubbles, can be trapped by the filters, and by reducing the number of branch flow paths through which the liquid flows, undesirable substances with fluidity can be permitted to pass through the filters. Therefore, the efficiency of trapping undesirable substances by the filters can be adjusted by the flow path opening/closing mechanism opening and closing the branch flow paths according to need.

In the foregoing liquid ejecting apparatus, the flow path opening/closing mechanism may make a number of branch flow paths through which the liquid flows greater as an amount of the liquid ejected to the medium is larger.

According to this configuration, when the amount of liquid ejection to the medium is large, the amount of the liquid supplied to the liquid ejector through the liquid supply flow path is large; however, by increasing the number of branch flow paths through which the liquid flows, the liquid can be divided into flows through those increased number of branch flow paths. Therefore, the flow speed of the liquid that passes through the filter provided in each of those branch flow paths decreases, so that fluidal undesirable substances contained in the liquid, if any contained, can be efficiently trapped by the filters. Therefore, it is possible to restrain the occurrence of incomplete ejection resulting from an undesirable substance reaching the liquid ejector.

The foregoing liquid ejecting apparatus may further include a pump mechanism that includes a pump chamber disposed between the filters and the liquid ejector and that performs a suction drive by increasing a volume of the pump chamber and performs a discharging drive by reducing the volume of the pump chamber. When the liquid is ejected to the medium, the flow path opening/closing mechanism may make the number of branch flow paths through which the liquid flows greater as the amount of the liquid drawn due to the suction drive of the pump mechanism is larger.

When the amount of the liquid drawn due to the suction drive of the pump mechanism becomes large, an increased amount of the liquid flows through the liquid supply flow path, so that if the number of branch flow paths through which the liquid flows is constant, the flow speed of the liquid that passes through the filters increases. In that respect, according to the foregoing configuration, the larger the amount of the liquid drawn due to the suction drive of the pump mechanism is, the greater the number of branch flow paths through which the liquid flows is made. Therefore, a large amount of the liquid supplied from the liquid supply source can be divided into flows through an increased number branch flow paths. Therefore, the flow speed of the liquid that passes through the filter provided in each branch flow path decreases, so that fluidal undesirable substances contained in the liquid, if any contained, can be efficiently trapped by the filters. Therefore, it is possible to reduce the amount of undesirable substances contained in the liquid supplied to the liquid ejector at the time of liquid ejection.

A liquid supplying apparatus according another aspect of the invention includes a liquid supply flow path that connects a liquid consumer that consumes a liquid and a liquid supply source, a plurality of branch flow paths for dividing the liquid into a plurality of flows in an intermediate portion of the liquid supply flow path, filters that are disposed separately in each of the branch flow paths, and a flow path opening/closing mechanism that opens and closes the branch flow paths.

According to this configuration, the liquid supplying apparatus can achieve substantially the same advantageous effects as the foregoing liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the liquid ejecting apparatus and the liquid supplying apparatus of the invention will be described hereinafter with reference to the accompanying drawings. An example of the liquid ejecting apparatus is an ink jet type printer that performs recording (printing) by discharging ink, which is an example of a liquid, to a medium such as a sheet of paper.

Figure 1:
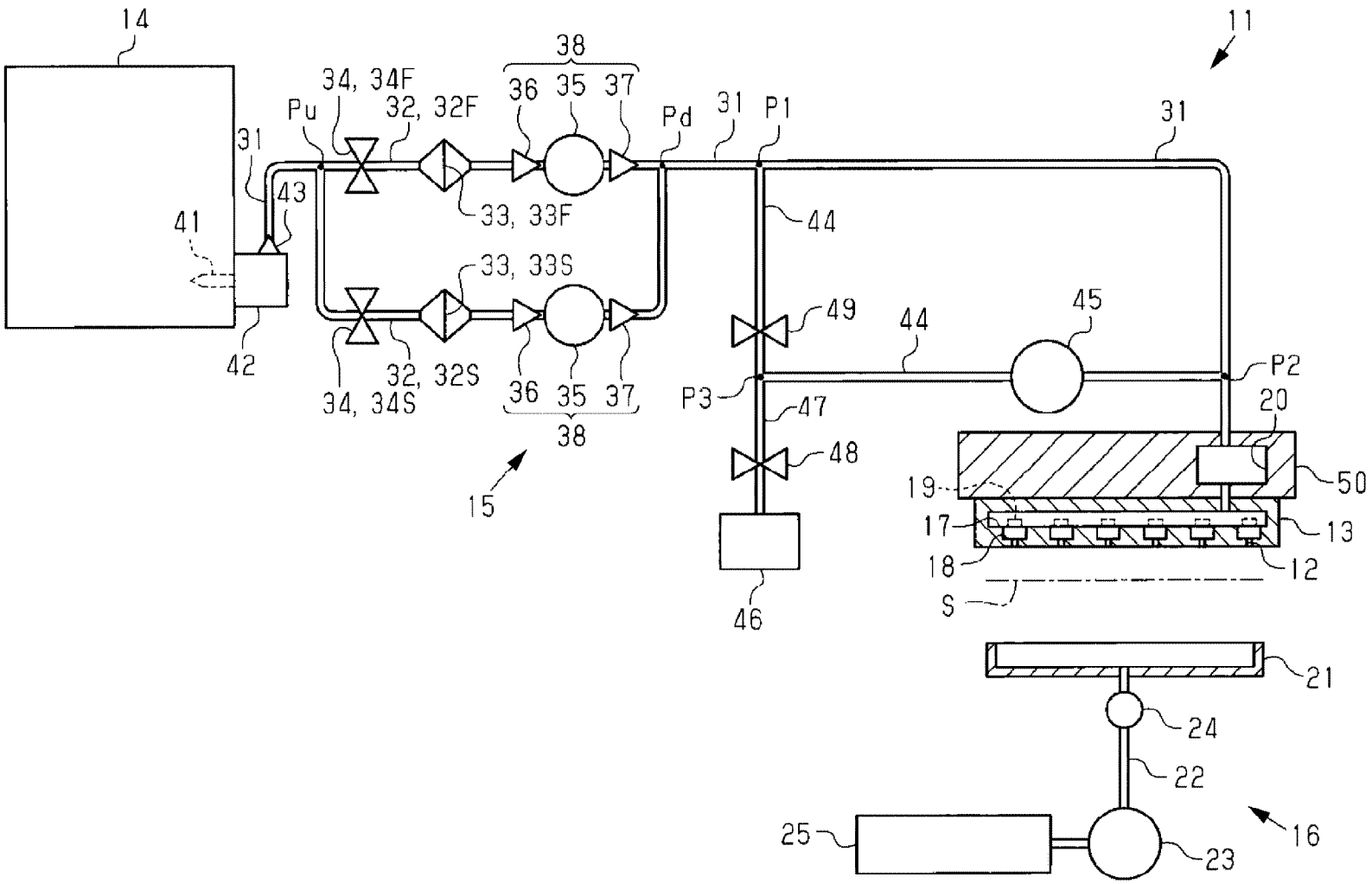
FIG. 1 is a schematic diagram showing a configuration of a liquid ejecting apparatus according to an exemplary embodiment of the invention.

As shown in FIG. 1, a liquid ejecting apparatus 11 according to an exemplary embodiment of the invention includes a liquid ejector 13 that ejects a liquid from one or more nozzles 12, a liquid supplying apparatus 15 that supplies the liquid contained in a liquid supply source 14 to the liquid ejector 13, and a maintenance apparatus 16 for performing maintenance of the liquid ejector 13. In this exemplary embodiment, the liquid ejector 13 functions as a liquid consumer that consumes the liquid by ejecting the liquid.

The liquid ejector 13 ejects one or more kinds of liquids (e.g., a plurality of inks of different colors) from the nozzles 12 to a medium S to perform recording (printing). The liquid ejector 13 may be held by a carriage 50 that is movable back and forth in width directions of the medium S that intersect with the transport direction of the medium S or may also be a so-called line head that has a corresponding width (length) in the width directions of the medium S.

The liquid ejector 13 includes a common liquid chamber 17 in which the liquid supplied by the liquid supplying apparatus 15 is temporarily stored, a plurality of cavities 18 provided so as to correspond individually to the nozzles 12, and actuators 19 that are provided so as to correspond separately to the cavities 18. Driven by the actuator 19, the liquid is ejected from the nozzles 12.

In the liquid ejecting apparatus 11, in order to prevent or resolve incomplete ejection that results from the clogging of nozzles 12, adhesion of an undesirable substance, etc., a maintenance operation, such as flushing, capping, or suction cleaning, is performed in the liquid ejector 13. The maintenance apparatus 16 includes a cap 21, a suction tube 22 whose upstream end is connected to the cap 21, a suction pump 23 provided at an intermediate portion of the suction tube 22, and an open/close valve 24 provided in the suction tube 22 between the suction pump 23 and the cap 21. A downstream end of the suction tube 22 has been connected to or inserted into a waste liquid container portion 25.

The aforementioned flushing is an operation of forcing droplets of the liquid to be ejected (discharged) from the nozzles 12 independently of printing so as to discharge undesirable substances, bubbles, or a degraded liquid (e.g., an ink having an increased viscosity due to evaporation of a solvent component) that can be a cause of incomplete ejection. The liquid discharged as a waste liquid by flushing may be received by the cap 21. Alternatively, a flushing box for receiving a waste liquid produced by flushing may be separately provided.

The cap 21 and the liquid ejector 13 are configured to be moved by a mechanism (not graphically shown) relatively to each other between a capping position at which the cap 21 and the liquid ejector 13 enclose and define a space to which the nozzles 12 are open as a closed space and a separate position at which a space to which the nozzles 12 are open is left as an open space. Then, by positioning the cap 21 at the capping position, the nozzles 12 are capped. When ejection of the liquid is not performed, the capping of the liquid ejector 13 is performed to restrain the nozzles 12 from drying and therefore substantially prevent incomplete ejection from occurring. Furthermore, when the waste liquid produced by flushing is to be received, the cap 21 is positioned at the separate position.

If a negative pressure generated by driving the suction pump 23 is applied to the closed spaced formed by positioning the cap 21 at the capping position, the negative pressure draws and discharges the liquid from the nozzles 12, whereby suction cleaning is executed. The liquid discharged from the nozzles 12 by suction cleaning is contained as a waste liquid in the waste liquid containing portion 25.

Before the liquid ejecting apparatus 11 begins to be used, execution of suction cleaning fills the liquid into a region extending from the liquid supply source 14 to the nozzles 12 in which the liquid flows. This is termed initial filling.

Next, a configuration of the liquid supplying apparatus 15 will be described.

The liquid supplying apparatus 15 includes a liquid supply flow path 31 that connects the liquid supply source 14 and the liquid ejector 13, a plurality of branch flow paths 32 (32F, 32S) for dividing the flow of liquid in an intermediate portion of the liquid supply flow path 31, filters 33 (33F, 33S) that are disposed individually in the branch flow paths 32 (32F, 32S), and a flow path opening/closing mechanism that opens and closes the branch flow paths 32. In this exemplary embodiment, two branch flow paths 32 and two filters 33 are provided as an example, it is also permissible to provide three or more branch flow paths 32 and three or more filters 33.

In this exemplary embodiment, a connecting portion between upstream ends of the branch flow paths 32 and the liquid supply flow path 31 is termed a branching portion Pu and a connecting portion between downstream ends of the branch flow paths 32 and the liquid supply flow path 31 is termed a meeting portion Pd. The connecting portions between the plurality of branch flow paths 32 and the liquid supply flow path 31 may vary in position depending on each branch flow path 32. In that case, the furthest upstream one of the connecting portions of the liquid supply flow path 31 is termed the branching portion Pu and the furthest downstream one of the connecting portions of the liquid supply flow path 31 is termed the meeting portion Pd.

The flow path opening/closing mechanism may be, for example, an open/close valve 34 (34F, 34S) provided in each of the branch flow paths 32 (32F, 32S). In this case, each branch flow path 32 is opened or closed as the open/close valve 34 opens to open that branch flow path 32 or closes to close the branch flow path 32.

The filters 33 may each be, for example, a meshed member, such as a metal mesh or a mesh made of resin, a porous member, a metal plate perforated with small through holes, etc. Concrete examples of the filters 33 made of meshed members include a metal mesh filter, a metal fiber, an electroforming metal filter, an electron beam processed metal filter, a laser beam processed metal filter. Furthermore, for example, a filter made by felting a fine wire of stainless steel (SUS according to JIS) or a metal sintered filter made by compressing and sintering a fine wire of the stainless steel may be used as a filter 33.

As for the holes of the filters 33, it is preferable that the bubble point pressure (pressure at which a meniscus formed at a hole breaks) not vary, and a filter that has a highly accurate hole diameter is appropriate. Note that the shape of the holes of the filters 33 can be a circular shape or a polygonal shape such as a square or hexagonal shape. In that case, it suffices that the length of a diagonal of the polygon is set smaller than the diameter of the opening of each nozzle 12.

As for the filtering particle size of the filters 33, it is preferable that, for example, in the case where the nozzles 12 have circular openings, the filtering particle size be smaller than the diameter of the openings, in order to prevent undesirable substances in the liquid from reaching the openings of the nozzles 12. For example, in the case where the openings of the nozzles 12 are circular and have a diameter of about 20 μm, it is appropriate to employ filters 33 whose filtering particle size is about 5 to 10 μm.

An example of a filter whose filtering particle size is about 10 μm is a twilled dutch weave mesh filter made of stainless steel. In this case, assuming that the surface tension that occurs between the filter and ink as an example of the liquid is about 28 mN/m, the bubble point pressure that occurs at filter holes is 3 to 5 kPa. Incidentally, in the case where a twilled dutch weave mesh filter made of stainless steel whose filtering particle size is about 5 μm is employed, the bubble point pressure that occurs with respect to the same ink is 10 to 15 kPa.

Furthermore, filters obtained by perforating metal plates with many small through holes at a predetermined density may be used as the filters 33. For example, if a metal plate made of stainless steel (SUS according to JIS) having a thickness of about 15 μm is perforated with several ten thousand through holes per 1 $cm^2$ whose internal diameter is 15 μm and is cut into circles having a diameter of about 8 to 9 mm, filters having intervals (pitches) of about 4 μm between adjacent through holes (filter holes) are obtained. Furthermore, since the diameter of the filter holes is the inside diameter (15 μm) of the through holes, the diameter (15 μm) of the filter holes can be set smaller than the diameter (about 20 μm) of the openings of the nozzles 12.

The liquid supplying apparatus 15 includes pump mechanisms 38 for pressurizing and supplying the liquid to the liquid ejector 13. Each pump mechanism 38 may be a positive displacement type pump that includes a pump chamber 35 disposed between a filter 33 and the liquid ejector 13 and also includes one-way valves 36 and 37 disposed upstream and downstream, respectively, of the pump chamber 35 and that performs a suction drive by increasing the volume of the pump chamber 35 and performs a discharging drive by reducing the volume of the pump chamber 35. Examples of positive displacement type pumps that can be employed include piston pumps, plunger pumps, diaphragm pumps, etc.

Although in this exemplary embodiment, a pump mechanism 38 is provided in each of the branch flow paths 32, it is also permissible to provide a pump mechanism 38 in the liquid supply flow path 31 between the branching portion Pu and the liquid supply source 14 or the liquid supply flow path 31 between the meeting portion Pd and the liquid ejector 13.

In the liquid supplying apparatus 15, an upstream end of the liquid supply flow path 31 is provided with a connector portion 42. The connector portion 42 includes a supply needle 41 capable of providing communication with inside of the liquid supply source 14. In order to prevent the liquid having flown out of the liquid supply source 14 into the liquid supply flow path 31 from flowing back and leaking when the connector portion 42 has been connected to the liquid supply source 14, it is preferable that a one-way valve 43 (check valve) be provided on the connector portion 42 or in a portion of the liquid supply flow path 31 which is near the connector portion 42.

If the liquid that the liquid ejector 13 ejects has a content that has a sedimentary characteristic, as is the case with the a pigment ink that contains a pigment, it is preferable that a circulation flow path 44 for circulating the liquid be provided in, for example, the liquid supply flow path 31 between the meeting portion Pd and the liquid ejector 13. In this case, if the circulation flow path 44 is provided with a circulating pump 45 for circulating the liquid, the liquid can be circulated between the liquid supply flow path 31 and the circulation flow path 44 by driving the circulating pump 45 so that this circulation can stir the liquid and therefore inhibit sedimentation of contents of the liquid. It is advisable that the circulation of the liquid via the circulation flow path 44 be performed, for example, prior to ejection of the liquid to the medium S.

Two connecting portions of the liquid supply flow path 31 with the circulation flow path 44 are termed a returning-and-joining portion P1 and a flowing-back portion P2 in order from the upstream side. If the liquid supply flow path 31 between the flowing-back portion P2 and the common liquid chamber 17 is provided with a liquid storage chamber 20 capable of storing the liquid, pressure changes of the liquid which occur as the liquid circulates are less likely to affect the liquid ejector 13. Therefore, such provision is preferable.

In the case where the circulation flow path 44 is provided, a release flow path 47 whose upstream end is connected to an intermediate portion of the circulation flow path 44 and whose downstream end is connected to a waste liquid storage portion 46 may be provided to fill the liquid into the circulation flow path 44 as initial filling before the liquid ejecting apparatus 11 begins to be used. A connecting portion of the circulation flow path 44 with the release flow path 47 is termed a connecting portion P3. An atmospheric opening valve 48 may be provided in an intermediate portion of the release flow path 47 and a closure valve 49 may be provided in the circulation flow path 44 between the connecting portion P3 and the returning-and-joining portion P1.

In this case, at the time of initial filling, while the closure valve 49 is in a closed state, suction cleaning is performed to fill the liquid into the liquid supply flow path 31. Then, while the atmospheric opening valve 48 is in an open state, the circulating pump 45 is driven as a first drive unit for a predetermined time, causing the liquid to flow from the liquid supply flow path 31 into the circulation flow path 44 via the flowing-back portion P2 and then flow through the release flow path 47 to the waste liquid storage portion 46. Due to this first drive, the circulation flow path 44 between the flowing-back portion P2 and the connecting portion P3 is filled with the liquid. At this stage, a section of the circulation flow path 44 which extends between the connecting portion P3 and the returning-and-joining portion P1 is not filled with the liquid.

Subsequently, after the closure valve 49 is opened and the atmospheric opening valve 48 is closed, the circulating pump 45 is driven as a second drive for a predetermined time. Then, the liquid flows from the liquid supply flow path 31 into the circulation flow path 44 via the flowing-back portion P2 and flows from the connecting portion P3 to the returning-and-joining portion P1, so that the not-yet-charged section of the circulation flow path 44, that is, the section extending from the connecting portion P3 to the returning-and-joining portion P1, is filled with the liquid as well. Due to this second drive, the gas (air) in the section of the circulation flow path 44 between the connecting portion P3 and the returning-and-joining portion P1 flows into the liquid supply flow path 31. Therefore, after the second drive, the suction cleaning is performed again to discharge gas from the flow path. Therefore, the circulation flow path 44 is entirely filled with the liquid and the initial filling is completed.

The initial filling of the circulation flow path 44 can also be accomplished together with the liquid supply flow path 31 by suction cleaning without provision of the release flow path 47, the atmospheric opening valve 48, nor the closure valve 49. However, in this case, the liquid needs to be supplied into the two flow paths (the liquid supply flow path 31 and the circulation flow path 44) and, furthermore, the liquid needs to be drawn through the liquid ejector 13, which has a large flow path resistance. Therefore, it is necessary to increase the drive force of the suction pump 23. On the other hand, in the case where the release flow path 47, the atmospheric opening valve 48, and the closure valve 49 are provided and where the initial filling of the circulation flow path 44 is performed by driving the circulating pump 45, the suction of the liquid through the liquid ejector 13 having a large flow path resistance does not need to be performed, thus achieving an advantage of there being no need to increase the drive force of the suction pump 23.

Next, a preferable configuration of the one-way valve 43 provided on or near the connector portion 42 will be described.

Figure 2:
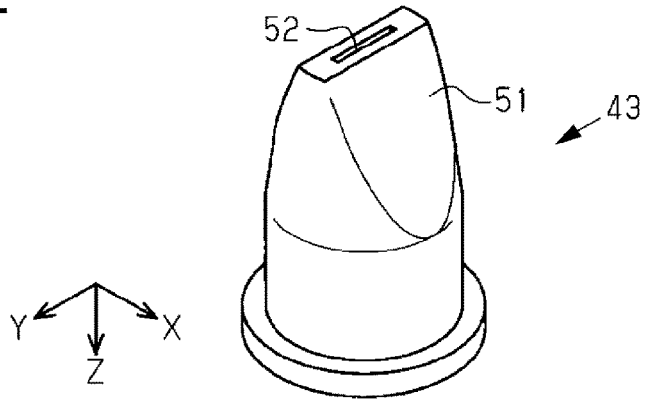
FIG. 2 is a perspective view showing an example of a one-way valve provided in the liquid ejecting apparatus shown in FIG. 1.

The one-way valve 43 is preferably, as shown in FIG. 2, a so-called duckbill valve in which a pair of elastically deformable inclined wall portions 51 forming a tapered shape is provided with a slit-shaped outlet opening 52 in a distal end portion of the tapered shape portion.

Figure 3:
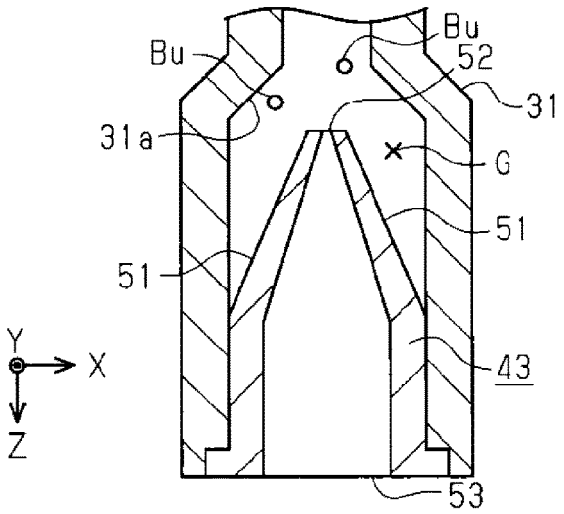
FIG. 3 is a sectional view of the one-way valve shown in FIG. 2.

As shown in FIG. 3, in the case where the one-way valve 43 that is a duckbill valve is fitted in the liquid supply flow path 31, if a configuration in which the flow path diameter of the liquid supply flow path 31 is reduced downstream of the one-way valve 43 is adopted, a predetermined space G is formed outside the outlet opening 52 of the one-way valve 43. In this case, it is advisable that an inner wall portion of the liquid supply flow path 31 along which the flow path cross-sectional area changes be formed as an inner wall portion 31*a* that has an inclined surface.

If small bubbles Bu and the like are present in the liquid, it sometimes happens that bubbles Bu reside in the space G, bubbles Bu merge into a large bubble Bu before the liquid flows out downstream from the space G. Then, there is a risk of a large bubble Bu entering a nozzle 12 (see FIG. 1) and causing incomplete ejection of the liquid.

Therefore, it is preferable that the one-way valve 43 be disposed in the liquid supply flow path 31 so that an inlet (inflow) opening 53 of the one-way valve 43 which is then an upstream-side opening thereof is positioned under the outlet opening 52 in a gravity direction Z, which is then a downstream-side opening of the one-way valve 43. Note that in FIGS. 2 to 4, a direction Y in which the outlet opening 52 stretches is orthogonal to the gravity direction Z and a direction X is orthogonal to the gravity direction Z and to the direction Y.

Due to the foregoing configuration, bubbles Bu in the space G outside the outlet opening 52 float upward along the inner wall portion 31*a* while flowing downward, so that bubbles B are less likely to reside in the space G. Therefore, even if the liquid contains bubbles Bu, the bubbles Bu can flow downstream while remaining small bubbles Bu that are not a cause of incomplete ejection.

Figure 4:
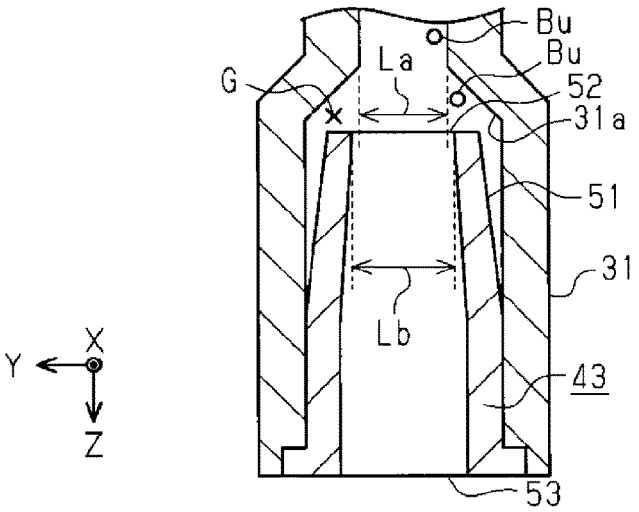
FIG. 4 is a sectional view of the one-way valve shown in FIG. 2 which is taken on a different plane of section from the view shown in FIG. 3.

As shown in FIG. 4, a length Lb of the outlet opening 52 in the direction Y may be longer than a diameter La of the flow path of the liquid supply flow path 31 at a location downstream of the one-way valve 43. In this case, the liquid flowing out of the outlet opening 52 strikes the inner wall portion 31*a* of the liquid supply flow path 31 so that the liquid is stirred in the space G. Therefore, even when the liquid has a sedimentary content, the stirring of the liquid residing in the space G restrains the sedimentation of such a content in the space G.

Next, a liquid supply operation that the liquid supplying apparatus 15 performs in the liquid ejecting apparatus 11 configured as described above and effects of the liquid ejecting apparatus 11 and the liquid supplying apparatus 15 will be described with reference to FIG. 1.

In the liquid ejecting apparatus 11, the liquid supplying apparatus 15 changes the number of branch flow paths 32 through which the liquid flows by opening or closing the open/close valves 34 to open or close the branch flow paths 32 according to the amount of the liquid supplied. For example, the liquid supplying apparatus 15 increases the number of branch flow paths 32 through which the liquid flows as the amount of the liquid ejected to the medium S increases.

Concretely, when the amount of the liquid ejected to the medium S by the liquid ejector 13 is large, all the open/close valves 34 are opened to supply the liquid through all the branch flow paths 32, whereas when the amount of liquid ejection is small, the number of branch flow paths 32 through which the liquid flows is reduced by closing one or more of the open/close valves 34.

For example, in the case where a line drawing of characters, graphics, and the like is to be printed on the medium S, it is not necessary to supply a large amount of the liquid (ink), the liquid supplying apparatus 15 closes the open/close valve 34S of one branch flow path 32S of the two and drives the pump mechanism 38 provided in the other branch flow path 32F to cause the liquid to flow only through the branch flow path 32F.

On the other hand, in the case of solid printing where a medium S is printed as if it were entirely painted, because a large amount of the liquid (ink) needs to be supplied, the liquid supplying apparatus 15 opens branch flow paths 32 by opening the open/close valves 34 that have been closed and thus increases the number of branch flow paths 32 through which the liquid flows. For example, in the case where two branch flow paths 32 are provided, both the open/close valves 34F and 34S of the two branch flow paths 32F and 32S are opened and the pump mechanisms 38 provided in the two branch flow paths 32F and 32S are driven.

Then, the liquid drawn from the liquid supply source 14 due to the suction drive of the pump mechanism 38 divides and flows into the two branch flow paths 32F and 32S and passes through the filters 33F and 33S provided in the two branch flow paths 32F and 32S before being supplied to the liquid ejector 13.

The amount of the liquid that flows through the liquid supply flow path 31 during the suction drive of the pump mechanism 38 is larger for solid printing than for line drawing printing. At the time of solid printing, the liquid in the liquid supply flow path 31 splits and flows into the two branch flow paths 32F and 32S and the thus split flows of the liquid pass through the different filters 33. Therefore, if, for example, at the time of solid printing, the amount of the liquid that flows through the liquid supply flow path 31 increases to twice the amount at the time of line drawing printing, the flow speed of the liquid passing through each filter 33 is equal to the flow speed at the time of line drawing printing.

Note that if undesirable substances, such as bubbles or gel-like fluidal masses, are contained in the liquid, such undesirable substances with fluidity are more likely to pass through the filters 33 as the flow speed of the liquid is faster. Therefore, in the case where the branch flow paths 32 are not provided, the larger the flow of the liquid is, the faster the speed at which the liquid passes through the filters 33 is and therefore the more likely undesirable substances are to pass through the filters 33. Then, the possibility of incomplete ejection of the liquid being caused by entrance of a bubble or a gel-like fluidal mass into a nozzle 12 becomes high.

However, if, when the flow of the liquid is increased, branch flow paths 32 are opened to divide the flow of the liquid and increase the number of filters 33 through which the liquid passes, the increase in the flow speed of the liquid passing through the filters 33 can be restrained, so that decrease in the trapping rate of fluidal undesirable substances can be restrained. Furthermore, if the number of filters 33 through which the liquid passes increases, the total area of the filters 33 through which the liquid passes increases and therefore the flow path cross-sectional area increases. As a result, even in the case where the amount of the liquid supplied is large, increases in the flow path resistance of the filters 33 can be restrained and therefore the liquid can be stably supplied.

Similarly, in the case where the numbers of branch flow paths 32 and of filters 33 are three or more, it is preferable that, when the liquid is ejected to the medium S, the opening and closing of the open/close valves 34 be controlled so that the larger the amount of the liquid ejected to the medium S, the larger the number of branch flow paths 32 through which the liquid flows.

Furthermore, at the time of execution of suction cleaning, the liquid supplying apparatus 15 closes one or more of the branch flow paths 32 to reduce the number of branch flow paths 32 through which the liquid flows. For example, at the time of execution of suction cleaning, the open/close valve 34S of the two open/close valves 34 is closed to close the branch flow path 32S, so that the liquid flows concentratedly through the branch flow path 32F. This increases the flow speed of the liquid that passes through the filter 33F provided in the branch flow path 32F, so that fluidal undesirable substances are more likely to pass through the filter 33F. Thus, the suction cleaning discharges the bubbles and the like trapped by the filter 33F from the nozzles 12, together with the liquid.

If, after the suction cleaning is executed, the open/close valve 34F of the branch flow path 32F is closed and the other open/close valve 34S is opened and suction cleaning in which the liquid is caused to flow through the branch flow path 32S is performed, the bubbles or the like trapped by the filter 33S can also be discharged from the nozzles 12, together with the liquid. Thus, by performing the suction cleaning to discharge the undesirable substances trapped by the filters 33, the clogging of the filters 33 by undesirable substances can be restrained.

Incidentally, when suction cleaning is performed, it is preferable that the amount of drive or the frequency of drive of each pump mechanism 38 be made greater than when liquid ejection is performed, so as to increase the flow speed of the liquid that passes through the filters 33. Furthermore, in the case where the amount of drive of the pump mechanism 38 is constant, a pump mechanism 38 provided in the liquid supply flow path 31 upstream of the branching portion Pu or downstream of the meeting portion Pd would make it possible that, when the number of branch flow paths 32 through which the liquid passes is reduced, the flow speed of the liquid that passes through the filters 33 of those reduced number of branch flow paths 32 can be increased.

Furthermore, particularly when the amount of the liquid drawn due to the suction drive of the pump mechanisms 38 is large at the time of liquid ejection to the medium S, it is preferable that the volume of the pump chamber 35 of each of the pump mechanisms 38 be slowly changed so that the amount of the liquid drawn per unit time is small. That is, in the case of a positive displacement type pump mechanism 38, the liquid discharge amount at the time of discharging drive is increased in order to increase the amount of the liquid supplied per unit time. Then, the amount of the liquid drawn per unit time during the suction drive usually increases, so that the flow speed of the liquid that passes through the filters 33 disposed between the liquid supply source 14 and the pump mechanisms 38 becomes fast and therefore undesirable substances are less likely to be trapped by the filters 33.

However, if, even when the volume change of each pump mechanism 38 during the discharging drive is fast, the volume change of each pump mechanism 38 during the suction drive is made slow, then the flow speed of the liquid that passes through the filters 33 disposed between the liquid supply source 14 and the pump mechanisms 38 becomes slow, so that the decrease in the rate at which the filters 33 trap undesirable substances can be restrained.

On the other hand, at the time of execution of suction cleaning, if the volume of each pump chamber 35 is changed fast to increase the frequency of drive, the amount of the liquid supplied per unit time increases, so that undesirable substances can be efficiently discharged together with the liquid.

When, during suction cleaning, the negative pressure generated by driving the suction pump 23 is applied to the nozzles 12, it is also permissible that first all the open/close valves 34 be closed and then the open/close valve 34S of the branch flow path 32S through which to pass the liquid be opened after the negative pressure is made large by suction. In this case, large negative pressures can be used to cause the liquid to flow, so that bubbles and the like caught on in a flow path can be efficiently discharged together with the liquid. The suction cleaning in which after suction is performed during the state in which the flow path is closed, the flow path is opened to rapidly flush the liquid is referred to as "choke cleaning" and a valve that closes the flow path at the time of choke cleaning is referred to as choke valve. In this case, the open/close valves 34 function as choke valves.

According to the foregoing exemplary embodiment, the following advantageous effects can be achieved.

(1) If the number of branch flow paths 32 through which liquid flows decreases, the liquid concentratedly flows through those reduced number of open branch flow paths 32 and therefore the flow speed of the liquid that passes through the filters 33 disposed in the open branch flow paths 32 becomes fast. On the other hand, if the number of branch flow paths 32 through which liquid flows increases, the liquid flowing through the liquid supply flow path 31 splits into those increased number of branch flow paths 32, so that the flow speed of the liquid that passes through the filters 33 decreases. Therefore, if the number of branch flow paths 32 through which the liquid flows is increased, undesirable substances with fluidity, such as bubbles, can be trapped by the filters 33, and if the number of branch flow paths 32 through which the liquid flows is reduced, fluidal undesirable substances can be permitted to pass through the filters 33. Therefore, by opening and closing the branch flow paths 32 via the open/close valves 34 (flow path opening/closing mechanisms) according to need, the efficiency of trapping undesirable substances by the filters 33 can be adjusted.

(2) When the amount of the liquid ejected to the medium S is large, the amount of the liquid supplied to the liquid ejector 13 through the liquid supply flow path 31 is large. However, by increasing the number of branch flow paths 32 through which the liquid flows, the liquid can be caused to flow dispersedly through those increased number of branch flow paths 32. As a result, the flow speed of the liquid that passes through the filters 33 provided in the branch flow paths 32 is reduced, so that even when the liquid contains fluidal undesirable substances, such undesirable substances can be efficiently trapped by the filters 33. Therefore, by increasing the number of branch flow paths 32 through which liquid flows as the amount of the liquid ejected to the medium S is increased, the occurrence of incomplete ejection resulting from an undesirable substance reaching the liquid ejector 13 can be restrained.

Note that the foregoing exemplary embodiment may be modified as in the following modifications.

In the case where one of the branch flow paths 32 (e.g., the branch flow path 32F) always allows the liquid to flow through and the other branch flow paths 32 (e.g., the branch flow path 32S) are opened and closed so as to change the number of branch flow paths 32 through which the liquid flows, it is permissible to provide an open/close valve 34 as a flow path opening/closing mechanism only in each branch flow path 32 (e.g., the branch flow path 32S) whose flow path is opened and closed.

The flow path opening/closing mechanism may be a switching valve disposed in the branching portion Pu. In this case, using the switching valve, the number of branch flow paths 32 through which the liquid flows can be changed or the branch flow paths 32 through which the liquid flows can be selectively opened and closed.

The flow path opening/closing mechanism may open and close each of branch flow paths 32 separately from the others. Furthermore, when three or more branch flow paths 32 are provided, a plurality of branch flow paths 32 may be opened and closed together.

The flow path opening/closing mechanism may close a flow path by, for example, squeezing an elastically deformable tube.

The pump mechanism 38 is not limited to the positive displacement type pumps but may also be, for example, a tube pump, a rotary pump, etc.

In the case where each branch flow path 32 is separately provided with a pump mechanism 38 as in the foregoing exemplary embodiment, because stopping a given one of the pump mechanisms 38 restrains the flowing of the liquid through a corresponding one of the branch flow paths 32, each pump mechanism 38 may be caused to function as a flow path opening/closing mechanism.

A pump mechanism 38 may be provided in the liquid supply flow path 31 upstream of the branching portion Pu or downstream of the meeting portion Pd. In this case, at the time of liquid ejection to the medium S, it is preferable that the open/close valves 34 be opened or closed so that the larger the amount of the liquid discharged due to the discharging drive of the pump mechanism 38 or the amount of the liquid drawn due to the suction drive of the pump mechanism 38, the greater the number of branch flow paths 32 through which the liquid flows.

When the amount of the liquid discharged due to the discharging drive or the amount of the liquid drawn due to the suction drive of the pump mechanism 38 is large, an increased amount of the liquid flows through the liquid supply flow path 31, so that if the number of branch flow paths 32 through which the liquid flows is constant, the flow speed of the liquid that passes through the filters 33 increases. In that respect, according to the foregoing configuration, as the amount of the liquid discharged due to the discharging drive or the amount of the liquid drawn due to the suction drive of the pump mechanism 38 is larger, the number of branch flow paths 32 through which liquid flows is made larger. Therefore, a large amount of the liquid drawn from the liquid supply source 14 can be divided into flows through a plurality of branch flow paths 32. As a result, the flow speed of the liquid that passes through the filter 33 provided in each branch flow path 32 becomes relatively slow, so that even when the liquid contains an undesirable substance having fluidity, the undesirable substance can be efficiently trapped by the filters 33. Hence, the amount of undesirable substances contained in the liquid supplied into the liquid ejector 13 at the time of liquid ejection can be reduced.

The branch flow paths 32F and 32S may be provided with filters 33F and 33S whose areas are different from each other and the branch flow paths 32F and 32S may be selectively used to convey the liquid according to the amount of the liquid ejected. For example, in the case where the filter 33F has a larger area than the filter 33S, when the amount of the liquid ejected to the medium S is large, the liquid is caused to flow through the branch flow path 32F, and when the amount of the liquid ejected to the medium S is small, the liquid is caused to flow through the branch flow path 32S. This restrains decreases of the efficiency of trapping undesirable substances by the filters 33 even when the amount of the liquid supplied increases.

The liquid supply flow path 31 does not need to be provided with the circulation flow path 44. Incidentally, even in the case where the liquid does not contain a substance having a sedimentary characteristic, provision of a collection unit that collects undesirable substances such as bubbles on the circulation flow path 44 makes it possible to collect undesirable substances by circulating the liquid through the circulation flow path 44.

The liquid supply flow path 31 between the flowing-back portion P2 and the common liquid chamber 17 may be provided with a pressure regulation valve that adjusts the pressure of the liquid supplied to the common liquid chamber 17, instead of the liquid storage chamber 20. Alternatively, the liquid supply flow path 31 between the liquid storage chamber 20 and the common liquid chamber 17 may be provided with a pressure regulation valve that adjusts the pressure of the liquid supplied to the common liquid chamber 17.

In this case, the pressure regulation valve employed may be one that includes a liquid inflow chamber that communicates with a flowing-back portion P2 side (liquid storage chamber 20 side), a liquid-containing chamber which communicates with the common liquid chamber 17 side and whose internal volume changes as a diaphragm portion is displaced with changes in pressure, a communication flow path that provides communication between the liquid inflow chamber and the liquid-containing chamber, and a valve body that, when in a closed state, blocks the communication flow path. When the pressure in the liquid-containing chamber of this pressure regulation valve becomes lower than the pressure outside the diaphragm portion by a pressure difference that is greater than or equal to a predetermined value, the valve body of the pressure regulation valve, having blocked the communication flow path, assumes an open state to permit the liquid to flow through the communication flow path. Furthermore, when the valve body assumes the open state, the liquid flows from the liquid inflow chamber into the liquid-containing chamber so that the pressure in the liquid-containing chamber increases. Then, when the pressure difference from the pressure outside the diaphragm portion becomes smaller than the predetermined value, the valve body assumes the closed state, blocking the communication flow path. Thus, the pressure regulation valve is able to adjust the pressure of the liquid supplied to the common liquid chamber 17 within a predetermined range below the pressure in the liquid inflow chamber.

Each actuator 19 may be an actuator that includes piezoelectric elements (piezo elements) and may also be an actuator that includes an electrostatic drive element, an actuator that includes a heater element for heating the liquid to cause film boiling and that uses the pressure (expansion pressure) of a bubble produced by the film boiling to discharge a liquid droplet from the nozzle 12, etc.

The liquid that the liquid ejector ejects is not limited to ink but may also be, for example, a liquid material obtained by dispersing or mixing particles of a functional material in a liquid. For example, a liquid material containing in the form of dispersion or solution a material such as an electrode material or a color material (pixel material) for use in production of liquid crystal displays, EL (electroluminescence) displays, surface-emitting displays, etc. may be ejected to perform printing.

The medium is not limited to paper sheets but may also be a plastic film or a thin plate material, a cloth or clothing, such as a T-shirt, used in a textile printing apparatus or the like, or may also be three-dimensional objects such as stationeries or dining utensils.

The liquid consumer is not limited to one that consumes a liquid by ejecting it but may also be a unit that consumes a cleaning liquid along with the washing of an object, a unit that consumes a liquid by spraying the liquid for the purpose of cooling or moisture retention, dripping the liquid for the purpose of lubrication or moisture retention, or supplying the liquid for the purpose of adjusting the concentration, property, or the like of a liquid.

Furthermore, technical ideas that can be understood from the exemplary embodiments and the modifications described above will be described below.

(A) A liquid ejecting apparatus that includes a liquid ejector that ejects a liquid to a medium, a liquid supply flow path that connects a liquid supply source and the liquid ejector, a plurality of branch flow paths provided in the liquid supply flow path, filters that are disposed separately in each of the branch flow paths; and a flow path opening/closing mechanism that opens and closes the branch flow paths.

(B) A liquid ejecting apparatus based on the foregoing technical idea (A) in which the flow path opening/closing mechanism makes the number of branch flow paths through which the liquid flows greater as the amount of the liquid ejected to the medium is larger.

(C) A liquid ejecting apparatus based on the foregoing technical idea (A) which further includes a pump mechanism that includes a pump chamber disposed between the filters and the liquid ejector and that performs a suction drive by increasing the volume of the pump chamber and performs a discharging drive by reducing the volume of the pump chamber. This apparatus is configured so that, when the liquid is ejected to the medium, the flow path opening/closing mechanism makes the number of branch flow paths through which the liquid flows greater as the amount of the liquid drawn due to the suction drive of the pump mechanism is larger.

According to these configurations, even when a filter is clogged with a trapped undesirable substance or the like, the undesirable substance-trapping performance can be recovered by replacing the filter. Incidentally, in the case where replenishment of the liquid is accomplished by replacing the liquid supply source, it is advisable that a filter be provided within a cartridge or the like that houses a liquid container that serves as the liquid supply source so that replacement of a cartridge will simultaneously accomplish replacement of a filter.

Furthermore, in the case where one of the branch flow paths always allows the liquid to flow through and the other branch flow paths are opened and closed to change the number of branch flow paths through which the liquid flows, it is also possible to adopt a configuration that allows replacement of only one or more of the filters, for example, the filter provided in the branch flow path that always allows to the liquid flow.

Furthermore, it is also permissible to adopt a configuration in which when only one or more of the branch flow paths are conveying the liquid in order to supply the liquid, the filters disposed in the other branch flow paths not conveying the liquid are replaced. With this configuration, it is possible to replace filters without stopping supplying the liquid.

This application is a continuation of U.S. application Ser. No. 15/212,602, filed Jul. 18, 2016, which claims priority to Japanese Patent Application No. 2015-153383, filed Aug. 3, 2015 the entireties of which are incorporated by reference herein.

What is claimed is:

1. A method of discharging fluid in a liquid ejecting apparatus comprising the steps of:

providing the liquid ejecting apparatus having:

a liquid ejector that has a nozzle opening and ejects a liquid to a medium from the nozzle opening;

a first flow path that connects a liquid supply source and the nozzle opening and designed to supply the liquid in the liquid supply source toward the nozzle opening;

a second flow path that has a first end and a second end, the first end being connected to the first flow path at a first portion, the second end being connected to the first flow path at a second portion, the second portion being positioned on the nozzle opening side from the first portion in the first flow path, and the second flow path and the first flow path constituting a circulation flow path;

a third flow path connected to the second flow path at a connection portion between the first end and the second end, the third flow path being designed to discharge fluid in the second flow path to an outside;

a flow mechanism designed to cause the liquid in the first flow path to flow toward the nozzle opening via the first flow path;

a circulation mechanism designed to circulate the liquid in the circulation flow path;

a first opening/closing mechanism designed to open and close the third flow path;

performing a first operation of driving the circulation mechanism in a state where the first opening and closing mechanism opens the third flow path to discharge a fluid existing in the second flow path via the third flow path and fill the second flow path with the liquid;

performing a second operation of driving the circulation mechanism in a state where the first opening/closing mechanism closes the third flow path to discharge the fluid remaining in the second flow path to the first flow path, and performing a third operation of driving the flow mechanism to discharge the fluid discharged from the second flow path via the liquid ejector, wherein the fluid discharged from the second flow path to the first flow path in the second operation is discharged as waste fluid via the liquid ejector in the third operation, and wherein a flow direction of the fluid in the first path in the first operation is same as a direction in which the liquid in the liquid supply source is supplied toward the nozzle opening.

2. The method of discharging fluid in a liquid ejecting apparatus according to claim 1, further comprising the steps of:

performing a filling operation of driving the flow mechanism to fill the first flow path with the liquid before the first operation is performed.

3. The method of discharging fluid in a liquid ejecting apparatus according to claim 1, wherein the liquid ejecting apparatus has a second opening/closing mechanism designed to open and close the second flow path, the second opening/closing mechanism being provided between the connection portion and the first end, and wherein the first operation is performed in a state where the second opening/closing mechanism closes the second flow path.

4. The method of discharging fluid in a liquid ejecting apparatus according to claim 1, wherein the liquid ejecting apparatus has a suction pump designed to apply a negative pressure to a space including the nozzle opening while driven, and wherein the suction pump is driven as the flow mechanism in the third operation.

5. The method of discharging fluid in a liquid ejecting apparatus according to claim 1, wherein the liquid ejecting apparatus has a suction pump designed to apply a negative pressure to a space including the nozzle opening while driven, and wherein the suction pump is driven as the flow mechanism in the filling operation.

6. The method of discharging fluid in a liquid ejecting apparatus according to claim 1, wherein the liquid ejecting apparatus has a plurality of branch flow paths provided in the first flow path and a flow path opening/closing mechanism that opens and closes the branch flow paths, and further comprising the steps of:

performing a discharging operation of driving the flow mechanism to discharge the fluid discharged from the second flow path via the liquid ejector in a state where the flow path opening/closing mechanism close one or more of the branch flow paths to reduce a number of branch flow paths through which the liquid flows.

7. The method of discharging a fluid in a liquid ejecting apparatus according to claim 1, wherein the liquid ejecting apparatus has a pressure regulating mechanism that includes a valve body provided on the nozzle opening side from the second portion in the first flow path, the valve body being switched from a closed state where the first flow path is closed to an open state that allows a flow of a fluid toward the nozzle opening side in the first flow path.

8. The method of discharging fluid in a liquid ejecting apparatus according to claim 1, wherein a flow direction of the fluid in the first path in the second operation is same as a direction in which the liquid in the liquid supply source is supplied toward the nozzle opening.

9. The method of discharging fluid from a liquid ejecting apparatus according to claim 3, wherein the circulation mechanism is a circulation pump located between the second end and the connection portion in the second flow path.

10. A method of discharging fluid in a liquid ejecting apparatus comprising the steps of:

providing the liquid ejecting apparatus having:

a liquid ejector that has a nozzle opening and ejects a liquid to a medium from the nozzle opening;

a first flow path that connects a liquid supply source and the nozzle opening and designed to supply the liquid in the liquid supply source toward the nozzle opening;

a second flow path that has a first end and a second end, the first end being connected to the first flow path at a first portion, the second end being connected to the first flow path at a second portion, the second portion being positioned on the nozzle opening side from the first portion in the first flow path, and the second flow path and the first flow path constituting a circulation flow path;

a third flow path connected to the second flow path at a connection portion between the first end and the second end, the third flow path being designed to discharge fluid in the second flow path to an outside;

a flow mechanism designed to cause the liquid in the first flow path to flow toward the nozzle opening via the first flow path;

a circulation mechanism designed to circulate the liquid in the circulation flow path;

a first opening/closing mechanism designed to open and close the third flow path;

performing a first operation of driving the circulation mechanism in a state where the first opening and closing mechanism opens the third flow path to discharge a fluid existing in the second flow path via the third flow path and fill the second flow path with the liquid;

performing a second operation of driving the circulation mechanism in a state where the first opening/closing mechanism closes the third flow path to discharge the fluid remaining in the second flow path to the first flow path, and performing a third operation of driving the flow mechanism to discharge the fluid discharged from the second flow path via the liquid ejector in a state where the first flow path is able to supply the liquid in the liquid supply source to the nozzle opening, wherein the first operation is performed in a state where a fluid in the first path is able to flow, and wherein a flow direction of the fluid in the first path in the first operation is same as a direction in which the liquid in the liquid supply source is supplied toward the nozzle opening.

11. The method of discharging fluid in a liquid ejecting apparatus according to claim 10, wherein the fluid discharged from the second flow path to the first flow path in the second operation is discharged as waste fluid via the liquid ejector in the third operation.

12. The method of discharging fluid in a liquid ejecting apparatus according to claim 10, wherein a flow direction of the fluid in the first path in the second operation is same as a direction in which the liquid in the liquid supply source is supplied toward the nozzle opening.

* * * * *